US005123489A

United States Patent [19]

Davis et al.

[11] Patent Number: 5,123,489

[45] Date of Patent: Jun. 23, 1992

[54] MILLING TOOL AND METHOD FOR REMOVING A PACKER

[75] Inventors: John P. Davis, Anchorage, Ak.; Robert S. Beeman, Rossier City, La.

[73] Assignee: Baker Hughes Incorporated

[21] Appl. No.: 663,095

[22] Filed: Mar. 1, 1991

[51] Int. Cl.[5] ..... E21B 10/64; E21B 29/00

[52] U.S. Cl. ..... 166/377; 166/55.7; 294/86.34

[58] Field of Search ..... 166/376, 377, 55, 55.7, 166/55.8, 178; 294/86.34

[56] References Cited

U.S. PATENT DOCUMENTS

| | | | |
|---|---|---|---|
| 1,779,123 | 10/1930 | Gates . | |
| 1,917,135 | 7/1933 | Littell . | |
| 2,904,114 | 9/1959 | Webb et al. | 294/86.34 X |
| 3,019,840 | 2/1962 | Kennard | 294/86.34 X |
| 3,091,290 | 5/1963 | Clark, Jr. | 166/55 |
| 3,108,637 | 10/1963 | Lee et al. | 294/86.34 X |
| 3,114,416 | 12/1963 | Kammerer | 166/55.7 |
| 4,191,255 | 3/1980 | Rives | 166/55.7 X |
| 4,273,372 | 6/1981 | Sheshtawy | 294/86.15 |
| 4,616,721 | 10/1986 | Furse | 175/320 |
| 4,696,502 | 9/1987 | Desai | 294/86.17 |
| 4,969,514 | 11/1990 | Morris et al. | 166/55.7 X |
| 4,991,649 | 2/1991 | Steinkamp | 294/86.34 X |

*Primary Examiner*—William P. Neuder

*Attorney, Agent, or Firm*—Dodge, Bush, Moseley & Riddle

[57] ABSTRACT

A milling and retrieval tool (10) to remove a packer (14) from a casing (12), and a method to release the tool (10) from the packer (14) for separate removal from the casing (10). Tool (10) includes a sleeve (58) having resilient fingers (60) which spring inwardly against a reduced diameter mandrel portion (42) in the upward position of the sleeve (58) to permit passage of the sleeve (58) through the packer bore (15) for release of the tool (10) from the packer (14). The sleeve (58) is moved upwardly along the mandrel (11) by pressurized drilling fluid discharged from a lower opening (32) of a bullnose section (26). A shear ring (50) is provided to permit downward movement of the sleeve (58) adjacent a reduced diameter portion (30) of the bullnose section (26) for release of the tool (10) from the packer (14) upon the reaching of a predetermined jarring or bumping action of the sleeve (58) against the packer shoulder (18).

8 Claims, 3 Drawing Sheets

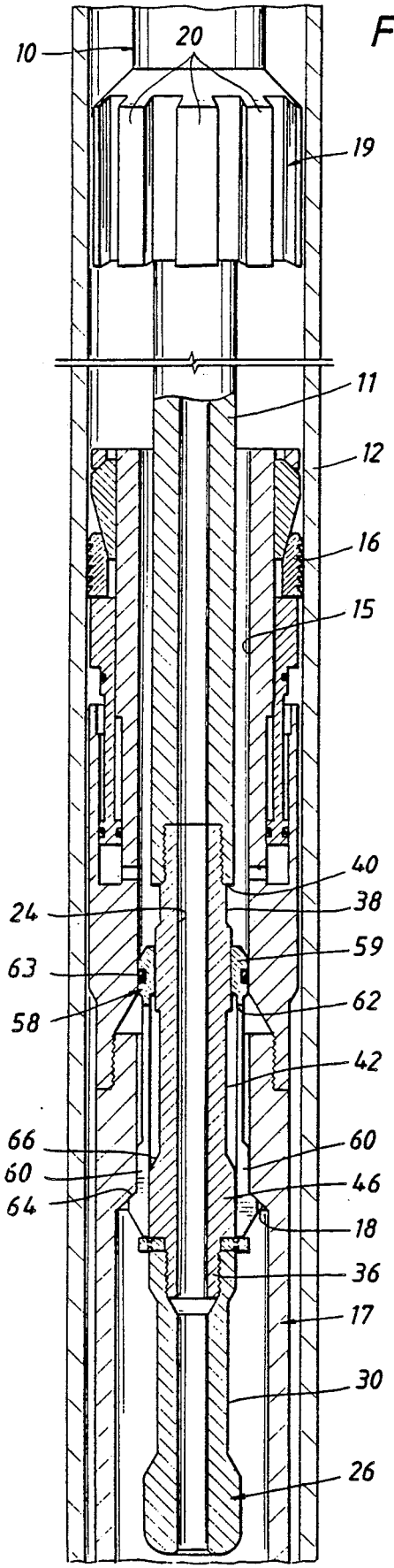
FIG. 2
FIG. 3
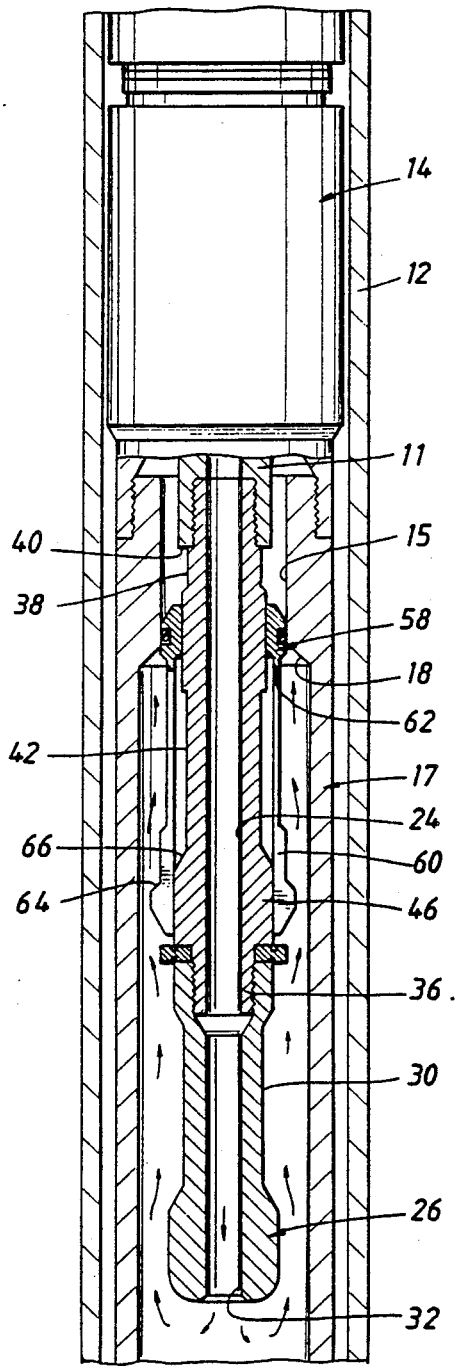

MILLING TOOL AND METHOD FOR REMOVING A PACKER

FIELD OF THE INVENTION

This invention relates to a milling tool and method for removing a packer from a casing in an oil or gas well, and more particularly to such a milling tool including means for gripping and pulling packer remains from the casing.

BACKGROUND OF THE INVENTION

A packer is inserted within a casing in a well bore to isolate certain producing zones of a well. The packers normally have an elastomeric seal between the outer circumference of the packer and the inner periphery of the casing for providing a seal between the packer and the casing when the packer is actuated. When a production zone is depleted or it is no longer producing the desired product, it is necessary to remove the packer from the packer and well bore. A packer retrieval tool is normally used to remove the packer as the packer usually can not be easily lifted and removed from the well bore. Slips which bite into the adjacent casing wall are usually employed for anchoring the packer within the casing and it is necessary to disengage the slips from the casing in order to remove the packer. Oftentimes, it is difficult to disengage the slips and a milling tool is required for milling or cutting through the slips. Then, the remainder of the packer can probably be gripped and pulled from the casing. For that purpose, a packer removal tool usually has an upper milling portion for cutting through the slips and a lower removal portion for gripping the remainder of the packer for pulling the packing remains from the bore hole after the slips have been cutaway.

Reference is made to U.S. Pat. No. 4,616,721 dated Oct. 14, 1986 as an example of a packer retrieval tool having an upper bladed portion for positioning above the packer for cutting through the slips, and a lower portion for positioning beneath the packer to grip and pull the packer from the well after removal of the slip and the application of a lifting action against the tool. Gripping fingers on the lower end portion are urged radially outwardly into gripping engagement with the inner periphery of the packer remains for lifting of the packer remains from the well.

As the packer is retrieved from the well, it often sticks in the casing as it is being pulled upwardly from various causes or objects, such as corrosion or dents on the casing walls, formation cuttings not flushed from the bore hole, or junk pieces left in the bore hole. Formation cuttings or junk pieces usually fall into and wedge between the packer and the adjacent casing wall causing intermittent hangups. Such hangups may cause disengagement of the retrieval tool from the packer. In addition, the drill string is raised and lowered during normal operation of the retrieval tool as a result of the removal of drill pipe sections as the drill string and retrieval tool are being lifted from the casing. Such movement likewise may cause the retrieval tool to become disengaged from the packer remains being removed. Further, the retrieval tool may be inadvertently pulled through the packer with the packer left in an intermediate position or falling down the casing to its original position.

U.S. Pat. No. 4,616,721 shows a retrieval tool having a slidable sleeve urged downwardly by a spring and including gripping fingers held in gripping relation against the packer by a releasable ring. Upon a sticking of the packer within the casing, an increased lifting force exerted by a mandrel connected to the tool is transmitted to the release ring through inclined ramps for failure of the ring from hoop tension. Upon a failure of the release ring, upward movement of the tool relative to the sleeve permits inward movement of the fingers into a reduced diameter portion of the tool for release of the tool from the packer. The tool is then withdrawn from the casing without the packer. Thus, the retrieval tool shown in U.S. Pat. No. 4,616,721 cannot be released from the packer unless the release ring fails and the release ring then must be replaced in order for the retrieval tool to be used again.

Other types of packer retrieval tools include a mandrel with lugs that are engaged and disengaged by rotation of the mandrel and this may cause inadvertent disengagement of the packer during the retrieval operation. If desired to disengage the packer, the mandrel is disengaged from the packer and withdrawn through the bore of the packer upon rotation of the mandrel. Thus, manipulation of the drill string is required for disengagement of the retrieval tool from the packer in such tools.

SUMMARY OF THE INVENTION

The present invention is directed to a combined milling and retrieval tool for removal of a packer from a casing. The retrieval tool includes a sleeve mounted for sliding movement on a mandrel and having depressible fingers that are urged inwardly against a reduced diameter portion of the mandrel during lowering of the tool through the packer bore upon upward movement of the sleeve against an abutment. After passing downwardly through the packer bore the resilient fingers spring outwardly into a radially expanded position beneath the packer and the sleeve slides downwardly on the mandrel by gravity. After the milling operation for cutting through the slips, the mandrel is lifted for removal of the packer from the casing and shoulders on the fingers engage an abutting surface on the packer to lift the packer from the casing for retrieval.

It may be desired to release the retrieval tool from the packer and to pull the tool from the casing without the packer such as may be required upon sticking of the packer within the casing, or for changing or checking the milling assembly. In this event, the mandrel is first lowered to remove the sleeve from engagement with the packer and then pressurized hydraulic fluid is discharged from the lower end of the tool for urging the slidable sleeve upwardly by fluid pressure to align the resilient fingers with a reduced diameter portion of the mandrel for inward movement of the fingers. Drilling fluid is discharged from the bullnose at the lower end of the retrieval tool and upon lifting of the mandrel the sleeve begins to enter the packer bore. At this time an increase in drilling fluid pressure occurs below the sleeve from the restriction formed by the packer bore to provide a fluid pressure differential to force the sleeve upwardly on the mandrel to position the fingers adjacent a reduced diameter portion of the mandrel. Upon positioning of the fingers laterally adjacent reduced diameter portion on the mandrel, the resilient fingers spring inwardly against the reduced diameter portion to permit the tool to pass through the packer bore upon further lifting of the mandrel for removal from the well without the packer.

At times, jarring of the retrieval tool against the packer is desirable to initially break the packer loose from the casing and at other times when the packer sticks in the casing during the removal operation such as might occur from a dented portion of the casing. Also, it may not always be possible to release the tool from the packer as a result of pressurized drilling fluid from the end of the tool. In this event, a release member is provided at the lower end of the sleeve for abutting the sleeve and upon a failure of the release member at a predetermined jarring force the sleeve moves downwardly to align the resilient fingers with another reduced diameter portion to permit inward movement of the fingers and subsequent passage of the tool through the packer bore for release of the tool from the packer.

It is an object of this invention to provide a combined milling and retrieval tool for a packer within a well bore with an upper milling portion for cutting the upper end of the packer and a lower retrieval portion of the tool passing through the packer bore upon lowering of the tool within the casing.

It is another object of this invention to provide such a combined milling and retrieval tool for a packer in which the lower retrieval portion of the tool is adapted for release from the packer and passage through the packer bore upon hydraulic actuation of a release means.

Another object of this invention is to provide a method for release of a retrieval tool from a packer in a well casing including the step of discharging pressurized drilling fluid from the end of the tool for sliding a gripping sleeve upwardly on the mandrel to permit inward movement of the resilient fingers for passage through the packer bore to release the tool from the packer.

An additional object is to provide a method for release of a retrieval tool from a packer in a well casing upon a predetermined upward jarring force exerted by the mandrel to shear a releasable safety ring and permit downward sliding movement of the sleeve to a reduced diameter portion of the mandrel for passage of the tool through the packer bore and release of the tool from the packer without damaging the tool.

Other objects, features, and advantages of this invention will become more apparent after referring to the following specification and drawings.

BRIEF DESCRIPTION OF THE DRAWINGS

FIG. 2 is a longitudinal sectional view of the lower end portion of the tool shown in FIG. 1B with resilient fingers of the gripping sleeve of the tool in abutting engagement with an annular shoulder on the packer for pulling the packer from the casing;

FIG. 3 is an enlarged longitudinal sectional view similar to FIG. 2 but showing the upper end of the gripping sleeve in initial sealing engagement with the packer bore and being urged in an upward direction along the mandrel by hydraulic fluid discharged from the lower end of the tool;

BRIEF DESCRIPTION OF THE INVENTION

Figure 1A:
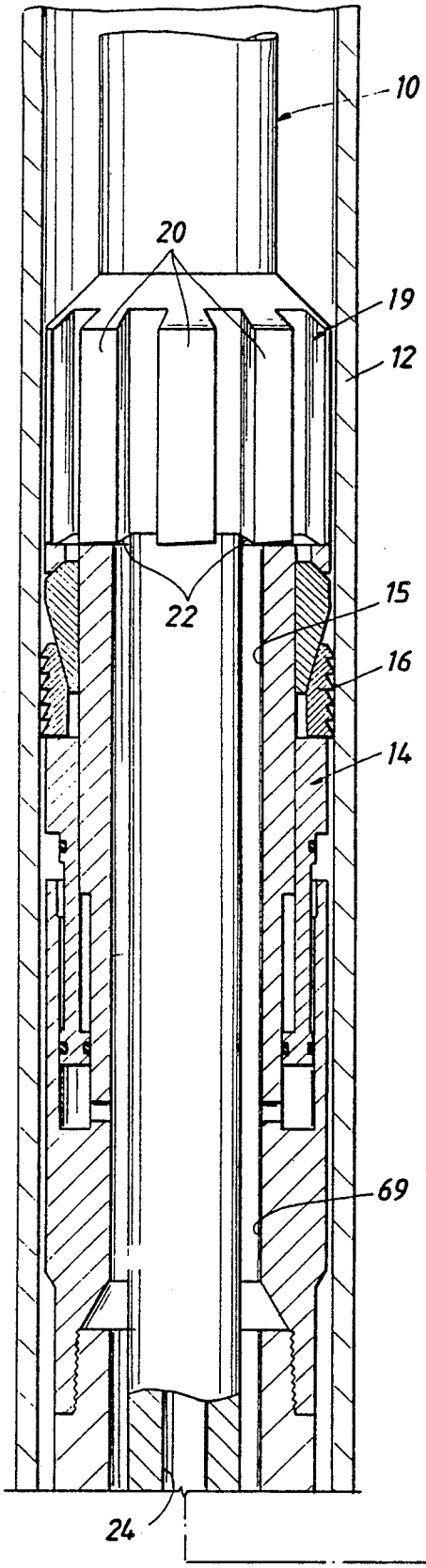
FIG. 1A is a longitudinal sectional view of an upper end portion of a combined milling and retrieval tool comprising the present invention received within an outer casing and showing the milling portion of the tool in cutting engagement with the upper end of a packer within the casing.

Referring now to the drawings for a better understanding of this invention, a combined milling and retrieval tool is shown generally at 10 mounted on the end of a mandrel 11 and received within an outer casing 12. A packer generally indicated at 14 has a central bore 15 receiving tool 10 and is secured by slips 16 to the inner periphery of casing 12. Packer 14 includes a lower end portion generally indicated at 17 having an internal shoulder or abutment 18 to define a small diameter upper bore portion above abutment 18 and a large diameter lower bore portion below abutment 18.

Tool 10 includes an upper mill generally indicated at 19 and having a plurality of spaced blades 20 projecting radially from the outer periphery of mandrel 11. Blades 20 are dressed with a hard facing material such as particles of cemented tungsten carbide and a brazing alloy matrix. The lower ends 22 of blades 20 engage the upper end of packer 14 in cutting relation for cutting through slips 16 to permit removal of packer 14 from casing 12. It is noted that the drawings show only a set of lower slips 16 but a set of upper slips would normally be provided for packer 14 and would be cutaway by mill 19.

Mandrel 11 has a central bore 24 for the flow of drilling fluid and has an end bullnose section generally indicated at 26 which includes a bullnose 28 and a reduced diameter section 30. Bullnose section 26 has an end discharge opening 32 at its lower end and has an internally threaded upper end 34 which is threaded onto an externally threaded end 36 of mandrel 11.

The lower end portion of mandrel 11 includes an upper reduced diameter or undercut section at 38 defining an upper shoulder or abutment 40 and an intermediate reduced diameter or undercut section 42 for defining an increased diameter portion 44 between reduced diameter portions 38 and 42. An increased diameter portion 46 on mandrel 11 is provided between reduced diameter intermediate portion 42 and reduced diameter portion 30 on bullnose section 26.

Figure 5:
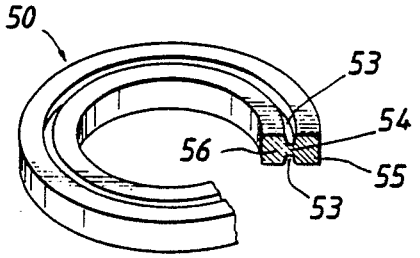
FIG. 5 is a perspective view of a releasable safety shear ring which forms a lower abutment for the gripping sleeve and is shown removed from the tool.

A shear ring generally indicated at 50 fits against a shoulder 52 about the reduced diameter end 36 of mandrel 11 and an abutting end of bullnose section 26 abuts shear ring 50 to hold shear ring 50 in tightly gripped position between bullnose section 26 and shoulder 52. As shown particularly in FIG. 5, shear ring 50 has a pair of opposed upper and lower annular grooves 53 to define a small thickness weakened portion 54 therebetween. Upon failure of weakened portion 54 at a predetermined loading condition as will be explained further hereinafter, outer portion 55 is sheared from inner portion 56.

Figure 4:
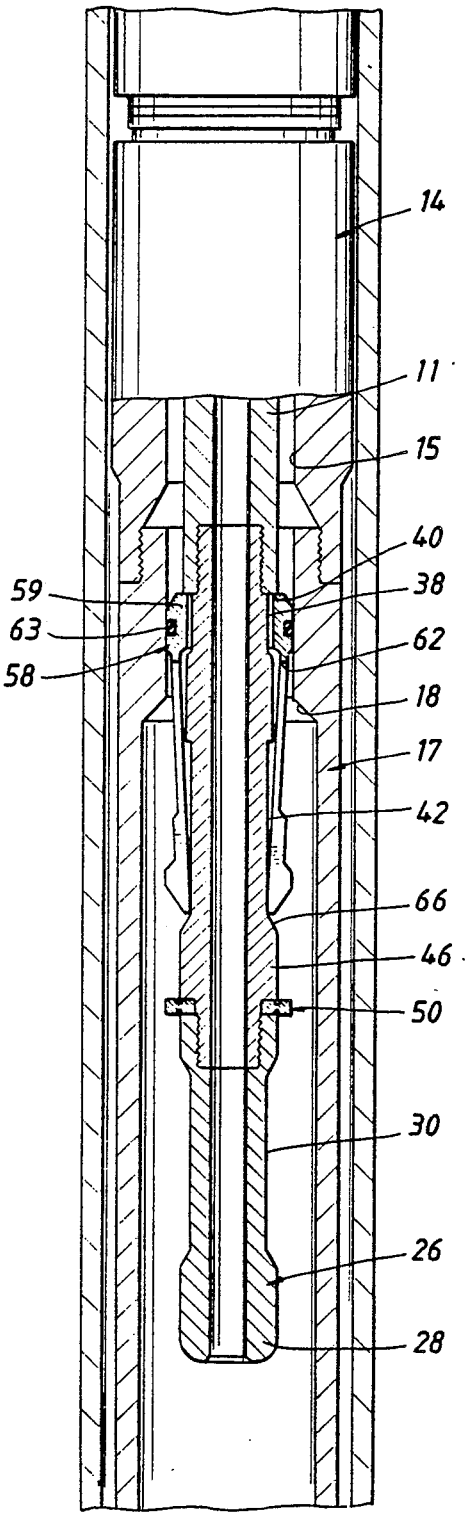
FIG. 4 is an enlarged longitudinal sectional view similar to FIG. 3 but showing the gripping sleeve raised by drilling fluid to a full raised position against a shoulder on the mandrel to permit deflection of the resilient fingers inwardly against a reduced diameter mandrel section for passage of the sleeve and tool through the packer bore for release of the tool from the packer.

Mounted for sliding movement on mandrel 11 is a sleeve or grapple indicated generally at 58 including an upper body portion 59 having a plurality of outwardly biased resilient fingers 60 spaced from each other by longitudinally extending slots 62. Upper body portion 59 has an O-ring 63 thereabout for contacting packer bore 15 in sealing relation. Fingers 60 have shoulders or abutments 64 thereon. Reduced diameter portion 42 of mandrel 11 forms an inclined shoulder or ramp 66 which cams or urges fingers 60 outwardly about large diameter portion 46 of mandrel 11 when sleeve 58 moves downwardly from the position shown in FIG. 4 for abutting shear ring 50. When mandrel 11 is lifted upwardly for retrieval of packer 14 as shown in FIG. 2, internal shoulder 18 on packer 14 is engaged by shoulders 64 on fingers 60 for lifting or pulling packer 14 from casing 12 for removal thereof.

Figure 1B:
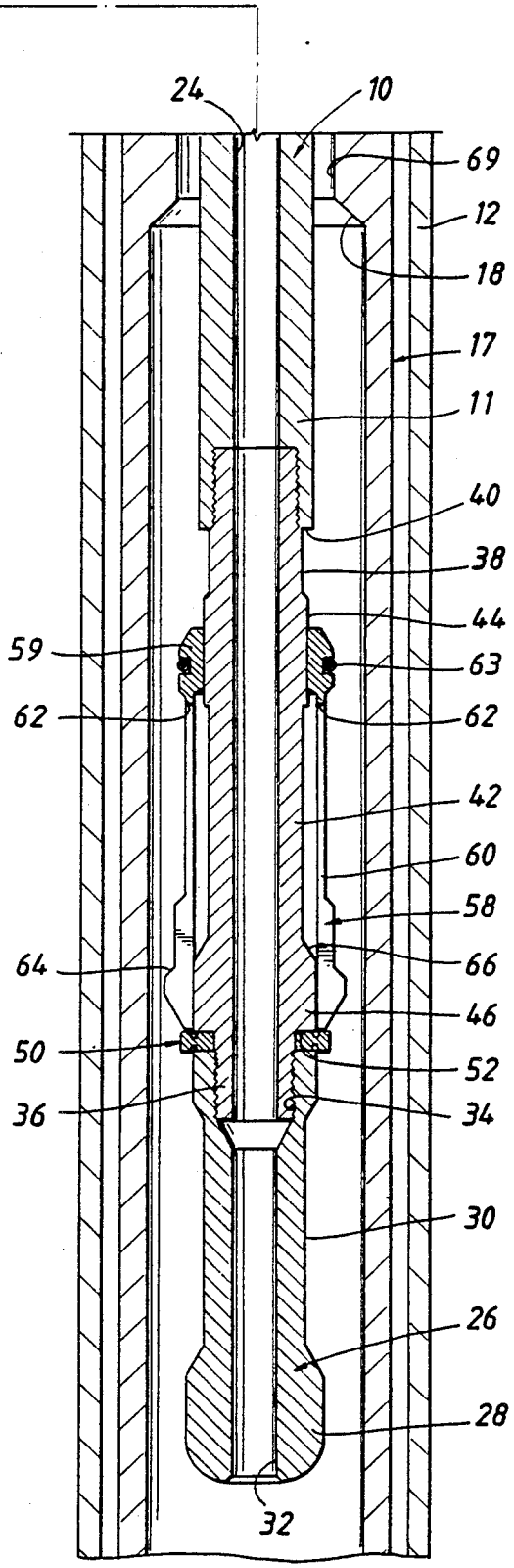
FIG. 1B is a longitudinal sectional view of the lower portion of the combined milled and retrieval tool shown in FIG. 1A with the gripping sleeve of the lower retrieval portion in an inoperative position.

In the event packer 14 becomes stuck in casing 12 and can not be removed from casing 12, it may be desirable for tool 10 to become disengaged from packer 14 so that it may be removed separately from casing 12. To disengage tool 10 from packer 14 from the position shown in FIGS. 1A and 1B, drilling fluid is discharged from end opening 32 in bullnose 28 and mandrel 11 is raised. As the upper end portion 59 of sleeve 58 approaches shoulder 18 an increase in fluid pressure occurs below shoulder 18 resulting from the restriction formed by the small diameter bore portion of the packer urges sleeve 58 upwardly toward abutment 40. Upon upward movement of sleeve 58 the lower ends of fingers 60 are positioned adjacent reduced diameter portion 42 and spring inwardly thereby to permit abutments 64 to pass packer shoulder 18 and be received within packer bore 15. Abutment 40 stops the upper movement of sleeve 58 and reduced diameter portion 38 permits a small leakage of drilling fluid around sleeve 58 in the event of an excessive buildup of fluid pressure beneath packer 14.

Figure 6:
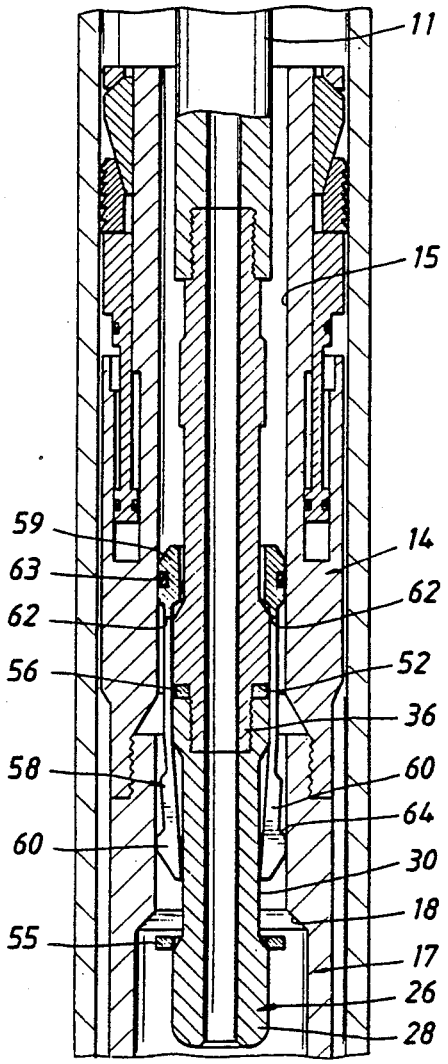
FIG. 6 is an enlarged longitudinal sectional view of the lower end of the tool with the shear ring failed upon an upward jarring or bumping action of the mandrel against the packer to minimize any damage to the tool and permit release of the tool from the packer.

At times it may desirable to jar or bump packer 14 in the event packer 14 becomes stuck in casing 12. For that purpose, mandrel 11 may be alternatively raised and lowered with abutments 64 engaging packer shoulder 18 in a jarring movement. Shear ring 50 is constructed with weakened portion 54 of predetermined dimensions so that shear ring 50 will fail upon a predetermined jarring force applied by mandrel 11 thereby to minimize possible damage to tool 10 in the event excessive jarring force is applied by mandrel 11. Thus, shear ring 50 acts as a safety device. Upon failure of shear ring 50 in a shearing action, outer shear ring portion 55 drops downwardly and is caught on bullnose 28 as shown in FIG. 6 and sleeve 58 moves downwardly with fingers 64 springing inwardly adjacent reduced diameter portion 30 on bullnose section 26. In this position, tool 10 may be withdrawn through packer bore 24 to be released from packer 14 and be removed from casing 12.

Thus, tool 10 in normal operation does not require the shearing of ring 50 and tool 10 can be pulled and pushed through packer bore 15 many times as fluid pressure is utilized to raise sleeve 58 to a position for passage through packer bore 15 in normal operation. Sleeve 58 is moved into abutting relation with abutment 40 by contact with packer 14 and fingers 60 retract against reduced diameter portion 42 to permit a downward movement through packer bore 15. Such a cycle can be repeated indefinitely if desired.

It may be desirable under some uses that the shear ring be deleted and that a fixed shoulder or abutment be utilized instead of shear ring 50. In that event, sleeve 58 would function in a similar manner except that the abutting shoulder supporting the lower end of fingers 60 would not be designed to fail upon a predetermined upward jarring action.

From the foregoing, it is apparent that no rotation of the drill string is necessary to place the gripping sleeve or grapple in an engaged or disengaged position as is typical of several other prior art designs. Further, it is highly desirable to have a hydraulically operated tool in highly deviated or directional wells where often it is very difficult to precisely torque or turn a device located deep within a well.

Also, when pulling the packer from the well with the present invention, there is no camming shoulder for the grapple or sleeve to inadvertently engage. Thus, the packer is always in an engaged position as long as there is no fluid flow through the tool.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. In a packer milling and retrieval tool including a mandrel having an upper milling portion with cutting blades for engaging the upper end of a packer in cutting relation, and a lower retrieval portion for contacting the lower end of the packer for removal of the packer from the casing, said mandrel having a central bore for drilling fluid and a reduced diameter portion with upper and lower abutting surfaces adjacent opposite ends of said reduced diameter portion;

an improved release means to permit said tool to be released from said packer for separate removal of the tool from the casing, said improved release means comprising:

a sleeve mounted on said mandrel for free sliding movement between said upper abutting surface on said mandrel and said lower abutting surface on said mandrel, said sleeve having an upper end portion and a plurality of resilient fingers extending downwardly from said upper end portion, each finger having an outwardly extending shoulder thereon and adapted to abut on said lower abutting surface of said mandrel in a retrieval position;

said packer having an internal abutment adjacent its lower end for contacting said shoulders on said fingers upon lifting of said mandrel for removal of said packer from said casing, said internal abutment defining a small diameter bore portion above the abutment and a large diameter bore portion below the abutment;

said sleeve when said fingers are disengaged from said packer abutment and spaced downwardly therefrom being slidable upwardly on said mandrel from a differential fluid pressure exerted against opposite ends of said sleeve provided by pressurized drilling fluid discharged from said tool upon the upper end portion approaching said small diameter bore portion from lifting of the mandrel to position said fingers adjacent said reduced diameter portion for inward deflection of said fingers to permit said fingers to pass said packer bore upon upward lifting movement of said mandrel to release said tool from said packer, said sleeve upon downward movement of said tool through said packer bore moving upwardly on said mandrel for inward movement said fingers against said reduced diameter portion to permit said sleeve to pass through said packer bore for positioning below said packer.

2. A method of releasing a packer milling and retrieval tool from a packer in a casing comprising the following steps:

providing a packer with an inner abutment to define an upper small diameter bore portion and a lower large diameter bore portion;

providing the retrieval tool with a slidable sleeve mounted for sliding movement between upper and lower abutting surfaces on a mandrel with a reduced diameter mandrel portion between said upper and lower abutting surfaces;

forming said sleeve with an upper end portion for being received in close fitting relation within the small diameter bore portion of said packer and with a plurality of downwardly extending spaced resilient fingers, each finger having an outer shoulder thereon adapted to engage an inner abutment on the packer for lifting of said packer from the casing upon lifting movement of the mandrel;

lifting said mandrel and sleeve thereon to a position in which said sleeve is closely spaced from the lower end of said small diameter bore portion;

discharging pressurized drilling fluid from the end of the tool for flow into the annulus between the tool and the lower portion of the packer for sliding said sleeve upwardly against said upper abutting surface of the mandrel to permit inward movement of said fingers toward the adjacent reduced diameter mandrel portion in a retracted position; and lifting said mandrel and sleeve with said fingers in a retracted position through the packer bore for release of the tool from the packer.

3. A milling and retrieval tool for engaging in cutting relation the upper end of a packer in a casing and for retrieval of the packer from the casing after the cutting operation; said tool comprising:

a mandrel having a central bore for drilling fluid and a reduced diameter portion with upper and lower abutting surfaces on the mandrel adjacent opposite ends of said reduced diameter portion;

a sleeve mounted on said mandrel for free sliding movement between said upper and lower abutting surfaces, said sleeve having a plurality of lower resilient fingers each having an outwardly extending shoulder thereon adapted to abut against said lower abutting surface of said mandrel in a retrieval position;

an internal abutment on said packer adjacent its lower end for contacting said shoulders on said fingers upon lifting of said mandrel for removal of said packer from said casing;

said mandrel bore having a lower discharge opening to discharge pressurized drilling fluid for flow into the annulus between said tool and said packer;

said sleeve when supported on said lower abutting surface and disengaged from said packer out of said packer bore being moved by pressurized drilling fluid from said discharge opening along the mandrel against said upper abutting surface to permit inward movement of said fingers against said reduced diameter material portion thereby allowing said tool to be withdrawn through said packer bore;

said mandrel having a lower bullnose section including a large diameter bullnose having said lower discharge opening therein and a lower reduced diameter portion adjacent said large diameter bullnose; and a shear ring defines said lower abutting surface and supports the lower end of said sleeve thereon in a retrieval position of said packer, said shear ring failing in shear upon a predetermined upward jarring action of said mandrel and finger shoulders against said packer abutment to permit said sleeve to slide downwardly upon failure of said ring to said lower reduced diameter portion for movement of said fingers to a retracted position and release of said tool from said packer.

4. A milling and retrieval tool for engaging in cutting relation the upper end of a packer in a casing and for retrieval of the packer from the casing after the cutting operation; said tool comprising:

a mandrel having a central bore for drilling fluid and a reduced diameter portion with upper and lower abutting surfaces on the mandrel adjacent opposite ends of said reduced diameter portion;

a sleeve mounted on said mandrel for free sliding movement between said upper and lower abutting surfaces, said sleeve having a plurality of lower resilient fingers each having an outwardly extending shoulder thereon adapted to abut against said lower abutting surface of said mandrel in a retrieval position; and an internal abutment on said packer adjacent its lower end for contacting said shoulders on said fingers upon lifting of said mandrel for removal of said packer from said casing;

said mandrel bore having a lower discharge opening to discharge pressurized drilling fluid for flow into the annulus between said tool and said packer;

said sleeve when supported on said lower abutting surface and disengaged from said packer out of said packer bore being moved by pressurized drilling fluid from said discharge opening along the mandrel against said upper abutting surface to permit inward movement of said fingers against said reduced diameter mandrel portion thereby allowing said tool to be withdrawn through said packer bore;

said mandrel having an upper reduced diameter portion between said upper abutting surface and said first mentioned reduced diameter portion, the upper end portion of said sleeve fitting within said upper reduced diameter portion when in abutting contact with said upper abutting surface of said mandrel and permitting a leakage of drilling fluid between the mandrel and sleeve.

5. A milling and retrieval tool for engaging in cutting relation the upper end of a packer in a casing and for retrieval of the packer from the casing after the cutting operation; said tool comprising:

a mandrel having a central bore for drilling fluid and a reduced diameter portion with upper and lower abutting surfaces on the mandrel adjacent opposite ends of said reduced diameter portion;

a sleeve mounted on said mandrel for free sliding movement between said upper and lower abutting surfaces, said sleeve having a plurality of lower resilient fingers each having an outwardly extending shoulder thereon adapted to abut against said lower abutting surface of said mandrel in a retrieval position;

an internal abutment on said packer adjacent its lower end for contacting said shoulders on said fingers upon lifting of said mandrel for removal of said packer from said casing;

said mandrel bore having a lower discharge opening to discharge pressurized drilling fluid for flow into the annulus between said tool and said packer;

said sleeve when supported on said lower abutting surface and disengaged from said packer out of said packer bore being moved by pressurized drilling fluid from said discharge opening along the mandrel against said upper abutting surface to permit inward movement of said fingers against said reduced diameter mandrel portion thereby allowing said tool to be withdrawn through said packer bore; and an annular resilient seal positioned about the upper end portion of said sleeve for sealing against said packer bore upon passage of said sleeve through said packer bore.

6. In a packer milling and retrieval tool including a mandrel having an upper milling portion with cutting blades for engaging the upper end of a packer in cutting relation, and a lower retrieval portion for contacting the lower end of the packer for removal of the packer from the casing, said mandrel having a central bore for drilling fluid and a reduced diameter portion with upper and lower abutting surfaces adjacent opposite ends of said reduced diameter portion;

an improved release means to permit said tool to be released from said packer for separate removal of the tool from the casing, said improved release means comprising:

a sleeve mounted on said mandrel for free sliding movement between said upper abutting surface on said mandrel and said lower abutting surface on said mandrel, said sleeve having a plurality of resilient fingers each having an outwardly extending shoulder thereon and adapted to abut on said lower abutting surface of said mandrel in a retrieval position;

said packer having an internal abutment adjacent its lower end for contacting said shoulders on said fingers upon lifting of said mandrel for removal of said packer from said casing;

said sleeve when said fingers are disengaged from said packer abutment and spaced downwardly therefrom being slidable upwardly on said mandrel from pressurized drilling fluid discharged from said tool to position said fingers adjacent said reduced diameter portion for inward deflection of said fingers to permit said fingers to pass said packer bore upon upward lifting movement of said mandrel to release said tool from said packer, said sleeve upon downward movement of said tool through said packer bore moving upwardly on said mandrel for inward movement of said fingers against said reduced diameter portion to permit said sleeve to pass through said packer bore for positioning below said packer;

said lower abutting surface on said mandrel comprising a shear ring adapted to fail upon a predetermined upward jarring action of said mandrel and finger shoulders against said packer abutment to permit said sleeve to slide downwardly.

7. A method of releasing a packer milling and retrieval tool from a packer in a casing comprising the following steps:

providing the retrieval tool with a slidable sleeve mounted for sliding movement between upper and lower abutting surfaces on a mandrel with a reduced diameter mandrel portion between said upper and lower abutting surfaces;

forming said sleeve with a plurality of spaced resilient fingers each finger having an outer shoulder thereon adapted to engage an inner abutment on the packer for lifting of said packer from the casing upon lifting movement of the mandrel;

discharging pressurized drilling fluid from the end of the tool for flow into the annulus between the tool and the lower portion of the packer for sliding said sleeve upwardly against said upper abutting surface of the mandrel to permit inward movement of said fingers toward the adjacent reduced diameter mandrel portion in a retracted position;

lifting said mandrel and sleeve with said fingers in a retracted position through the packer bore for release of the tool from the packer; and providing an annular seal about an upper portion of said sleeve for sealing between the sleeve and packer upon passage.

8. A method of releasing a packer milling and retrieval tool from a packer in a casing comprising the following steps:

providing the retrieval tool with a slidable sleeve mounted for sliding movement between upper and lower abutting surfaces on a mandrel with a reduced diameter mandrel portion between said upper and lower abutting surfaces;

forming said sleeve with a plurality of spaced resilient fingers each finger having an outer shoulder thereon adapted to engage an inner abutment on the packer for lifting of said packer from the casing upon lifting movement of the mandrel;

discharging pressurized drilling fluid from the end of the tool for flow into the annulus between the tool and the lower portion of the packer for sliding said sleeve upwardly against said upper abutting surface of the mandrel to permit inward movement of said fingers toward the adjacent reduced diameter mandrel portion in a retracted position;

lifting said mandrel and sleeve with said fingers in a retracted position through the packer bore for release of the tool from the packer;

mounting a shear ring on the lower abutting surface of said mandrel with the lower end of said sleeve supported thereon in the packer retrieval position of said sleeve; and weakening said shear ring along a predetermined area of said ring for shearing thereat upon a predetermined upward jarring action of said mandrel against said packer to permit a downward sliding movement of said sleeve to a reduced diameter portion of the mandrel before a damaging jarring action is exerted against said tool.

* * * * *